US006955244B2

(12) United States Patent
Yerman

(10) Patent No.: US 6,955,244 B2
(45) Date of Patent: Oct. 18, 2005

(54) INDIVIDUALLY OPERATED ESCAPE DEVICE

(76) Inventor: Arthur Yerman, 436 Mahon Dr., Venice, FL (US) 34285

( * ) Notice: Subject to any disclaimer, the term of this patent is extended or adjusted under 35 U.S.C. 154(b) by 0 days.

(21) Appl. No.: 10/663,883

(22) Filed: Sep. 16, 2003

(65) Prior Publication Data

US 2004/0112674 A1 Jun. 17, 2004

Related U.S. Application Data

(63) Continuation-in-part of application No. 09/689,283, filed on Oct. 12, 2000, now abandoned.

(51) Int. Cl.[7] ..... A62B 1/00
(52) U.S. Cl. ..... 182/142; 182/238; 182/7
(58) Field of Search ..... 182/142, 238, 182/233, 7; 254/377

(56) References Cited

U.S. PATENT DOCUMENTS 852,623 A * 5/1907 Roth ..... 182/77
2,703,219 A * 3/1955 Henshaw ..... 182/238
4,602,698 A * 7/1986 Grant ..... 182/142
5,826,679 A * 10/1998 Chern ..... 182/238

FOREIGN PATENT DOCUMENTS

EP 252196 A1 * 1/1988 ..... A62B/1/12

* cited by examiner

*Primary Examiner*—Alvin Chin-Shue

(57) ABSTRACT

The escape device is lowered via a cable which can be anchored above and outside a window of a burning building. The descent of the device is regulated by a speed regulating brake or by a valve mounted in a hydraulic line for manual operation by the user. A guide device for the cable is connected to a rigid seat on which the occupant would be seated while descending along a burning building. A pair of wheels are also provided at a lower end of the seat to space the seat from the building and to provide stability while descending along the height of the building. In another embodiment, a sling is suspended from the guide device in order to receive the occupants with the seat regulating brake and emergency brake located in an overhead manner. In another embodiment, a hydraulic energy absorber controls the unwinding of the cable from a reel mounted under the seat of the device.

7 Claims, 9 Drawing Sheets

27
28
29
30
31
32
33
34
35
36
36'
37
38
39
40
41
42
5
6

INDIVIDUALLY OPERATED ESCAPE DEVICE

This application is a Continuation-in-Part of application Ser. No. 09/689,283, filed Oct. 12, 2000, now abandoned.

This invention relates to an individually operated escape device. More particularly, this invention relates to an escape device for escaping from a burning building.

As is known, many people throughout the world become victims of fires due to smoke inhalation when trapped inside a building with no way out. Warning alarms and sprinkler systems, while effective in alerting people and reducing the rate of burn victims, do not provide for the safe exit of the occupants of the building.

It has been known that many buildings have been constructed with internal staircases which are intended to withstand the effects of a fire and from which smoke may be vented away. In addition, various types of devices have been proposed to facilitate escape from a burning building where access to a fire staircase is not possible. Typically, these devices have been of a type such as described in U.S. Pat. No. 1,073,293, wherein a carrier which supports an operator can be lowered to permit the operator to leave a burning building or to descend from a structure upon which the operator is working. However, such carriers are of rather cumbersome construction.

Other types of devices have also been proposed, such as described in U.S. Pat. No. 4,903,797 for lowering the occupants of a burning building using gondolas or the like which can be lowered using winches or as proposed in U.S. Pat. Nos. 4,256,199, 4,640,384 and 4,650,036.

It is an object of this invention to provide a relatively simple device which can be individually operated for escaping from a building.

It is another object of the invention to provide an escape device which can be readily put into use by an occupant of a burning building.

It is another object of the invention to provide an escape device which can be fabricated in a relatively simple manner.

Briefly, the invention is directed to an escape device which can be operated by an individual for escaping from a burning building. The escape device is characterized in employing an elongated guide having a bore for slidably receiving a cable means, such as a wire, chain or braided wire. In this respect, for many years, firemen have been awakened in a firehouse to respond to a call of duty and have used a "firehouse" pole to slide down from a second floor to a ground level. This invention employs the concept of using a "firehouse" pole as a guide in order to escape from a burning building.

The escape device includes a frame that has a seat for receiving at least one individual. In addition, at least one rotatable wheel is mounted on the frame below the seat for spacing the seat from a building.

In accordance with the invention, a vertically disposed guide is mounted on the frame at a forward position of the seat for guiding a cable means therein and a reel is rotatably mounted on the frame below the guide for unwinding of the cable means therefrom. In this respect, the cable means may be a wire, braided cable or the like. In addition, a free end of the cable means is provided with a hook or other securing means for securing the cable to a fixed support on or in a building. Typically, the length of cable means wound onto the reel is of a sufficient length to be able to lower an occupant to a ground surface from a floor of a building.

An energy absorber is also mounted on the frame and is operatively connected to the reel in order to regulate rotation of the reel. Further, a manually operable speed regulating valve is mounted on the frame in a location that can be readily accessed by an occupant for adjusting the energy absorber in order to control the speed of rotation of the reel and, thus, to control the rate of descent of the frame along the cable means.

When in use, the free end of the cable is secured at or adjacent to a window of a building while the frame is suspended on the outside wall of the building. The speed-regulating valve is manipulated in order to control the unwinding of the cable means from the reel so that the occupant of the escape device may be lowered to a ground surface at a greater or lesser speed.

The hydraulic energy absorber is constructed with a housing having an inlet for an inflow of hydraulic fluid and an outlet for an outflow of hydraulic fluid. In addition, a hydraulic line is connected to and between the inlet and the outlet to form a closed loop for the hydraulic fluid. The speed-regulating valve is mounted in the hydraulic line to selectively open and close the line to a flow of fluid. When the valve is closed, the energy absorber prevents the reel from rotating, whereas when the valve is open, the energy absorber is constructed to allow the reel to rotate and, thus, unwind the cable means wound thereon.

A second valve is also disposed in the hydraulic line to be opened and closed by a tail skid that depends from the frame of the escape device. This tail skid functions to contact a ground surface as the escape device is lowered and, on contact with the ground surface, actuates the second valve to close the hydraulic line to thereby brake the reel to a stop.

In another embodiment, instead of using a rigid seat, use may be made of a sling which is suspended from the guide in order to receive an individual. The sling is sized and positioned so that the brakes are accessible to the user.

These and other objects and advantages of the invention will become more apparent from the following detailed description taken in conjunction with the accompanying drawings wherein.

Figure 1:
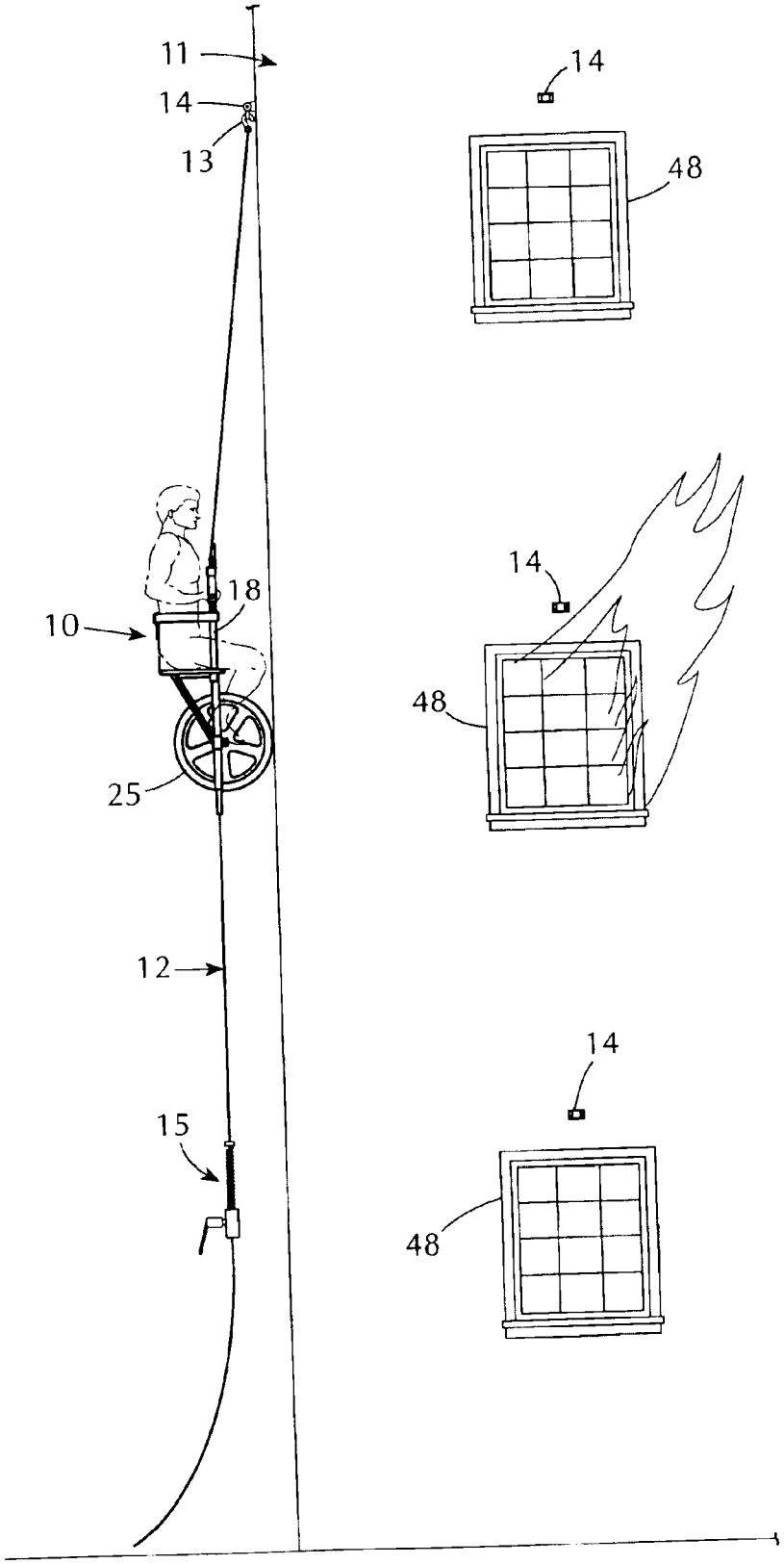
FIG. 1 illustrates a manner of use of an escape device in accordance with this invention.

Referring to FIG. 1, the escape device 10 is employed for escaping from a burning building 11 and particularly from the upper floors of the building.

The escape device 10 employs a cable means 12, for example, a rope, wire, chain or a braided cable which carries a hook 13 at an upper end for engaging an anchor means 14 on the building 11. In addition, a shock absorber 15 is mounted on the cable means 12 near a lower end for impacting of the escape device 10 thereon.

Figure 8:
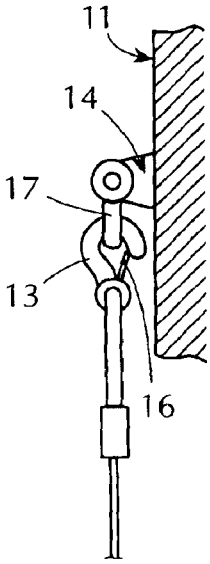
FIG. 8 illustrates one manner of mounting a cable means of the escape device to an anchor means in accordance with the invention.

Referring to FIG. 8, the hook 13 is J-shaped and has a spring biased locking plate 16 therein. The anchor means 14 is fixedly secured to the outside of the building 11 above a window frame and carries a depending eyelet 17 into which the J-shaped hook 13 is fitted. Once the hook 13 is in place, the locking plate 16 prevents disengagement of the hook 13 from the eyelet 17.

Figure 3:
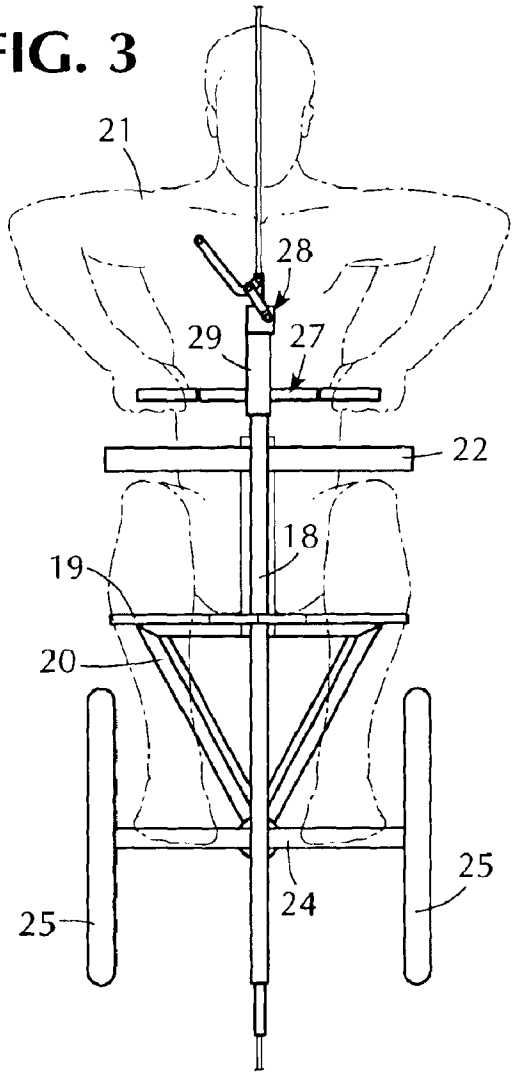
FIG. 3 illustrates a front view of the escape device of FIG. 2.
Figure 2:
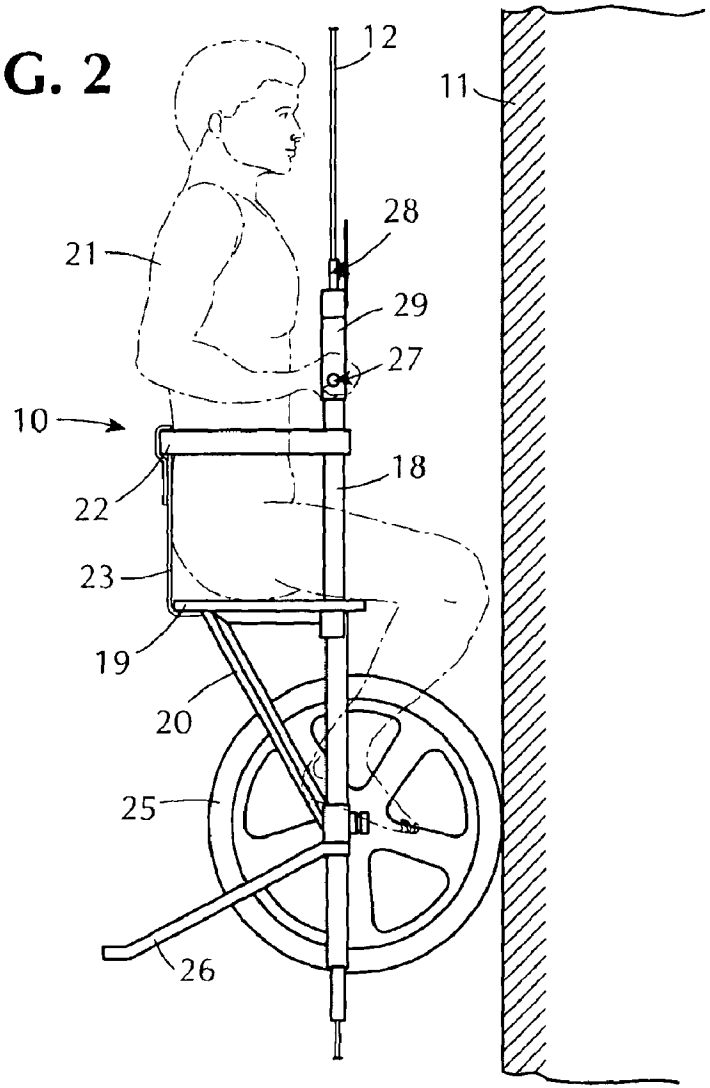
FIG. 2 illustrates a side view of the escape device of FIG. 1 with one wheel removed.
Figure 7:
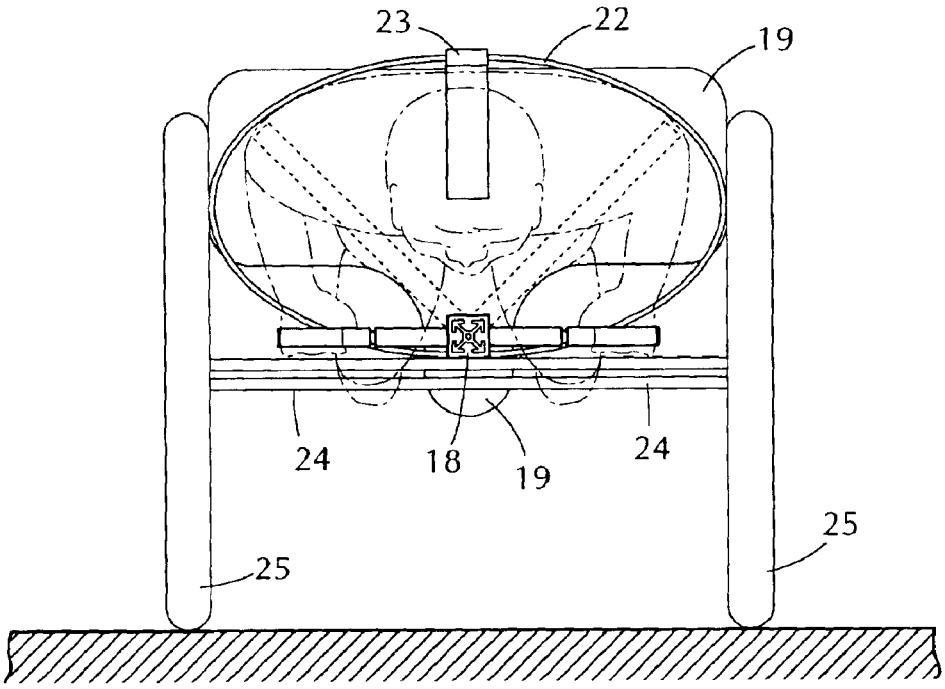
FIG. 7 illustrates a top view of the escape device of FIGS. 1 to 3.

Referring to FIGS. 1 and 2, the escape device 10 includes an elongated guide 18 which is slidably mounted on the cable means 12. As shown in FIG. 7, the guide 18 has a central bore, e.g. of 0.25 inches, for receiving the cable means 12 and is of skeletal cross-section with an overall rectangular shape of 1½ inches by 1½ inches. As indicated in FIGS. 1–3, the guide 18 has a substantial length, for example, three feet to four feet in length. In addition, the guide 18 is made of any suitable material, such as metal, for purposes of a rigidity. A suitable rigid plastic material may also be used.

The escape device 10 also has a horizontally disposed rigid seat 19 secured to the vertically disposed guide 18 via a truss-like frame 20 to receive an occupant 21 in a seated position. To this end, the seat 19 is bolted to the frame 20 and the frame 20 is secured at upper and lower ends to the guide 18 by bolts (not shown). As shown in FIG. 7, the seat 19 may be slid onto the guide 18 so that a portion of the seat 19 extends to the building side of the guide 18. This will provide further stability to the seat 19. In addition, a belt 22 is mounted on the vertically disposed guide 18 for enveloping the individual 21 seated on the seat 19. For example, the belt 22 may be similar to an automobile seat belt and is adjustable to fit about different sized individuals. The belt 22 may be secured directly to the guide 18 or may be slid between the guide 18 and a U-shaped bracket (not shown) mounted on the guide 18.

At least one flexible strap 23 is secured to and between the belt 22 and the seat 19 in order to further contain the individual 21 on the seat 19. As indicated in FIGS. 2 and 3, the belt 22 envelopes the occupant 21 about the mid-section.

A foot rest 24 in the form of a hollow horizontal bar is secured to each side of the guide 18 below the frame 20 as by suitable brackets (not shown) to lend further stability and comfort to the seated occupant 21. Each foot rest 24 also serves as a shaft in which a wheel 25 is rotatably mounted via a suitable bearing (not shown). As indicated in FIGS. 2 and 3, each wheel 25 is disposed below the seat 19 for spacing the seat 19 and occupant 21 from the building 11.

A skid 26, in the form of an outwardly and downwardly directed flat bar, is secured to the bottom of the guide 18 to act as a stabilizer upon the escape device 10 reaching a ground surface when placed into use.

Referring to FIGS. 2 and 3, the escape device 10 includes a manually operable speed regulating brake 27 mounted on the guide 18 for releasably engaging the cable means 12 in order to control the rate of descent of the escape device along the cable means. In addition, a manually emergency operated brake 28 is mounted on the guide 18 above the speed regulating brake 26 for releaseably engaging the cable means 12 in order to arrest descent of the seat 19 along the cable means 12.

Figures 4, 5, 6:
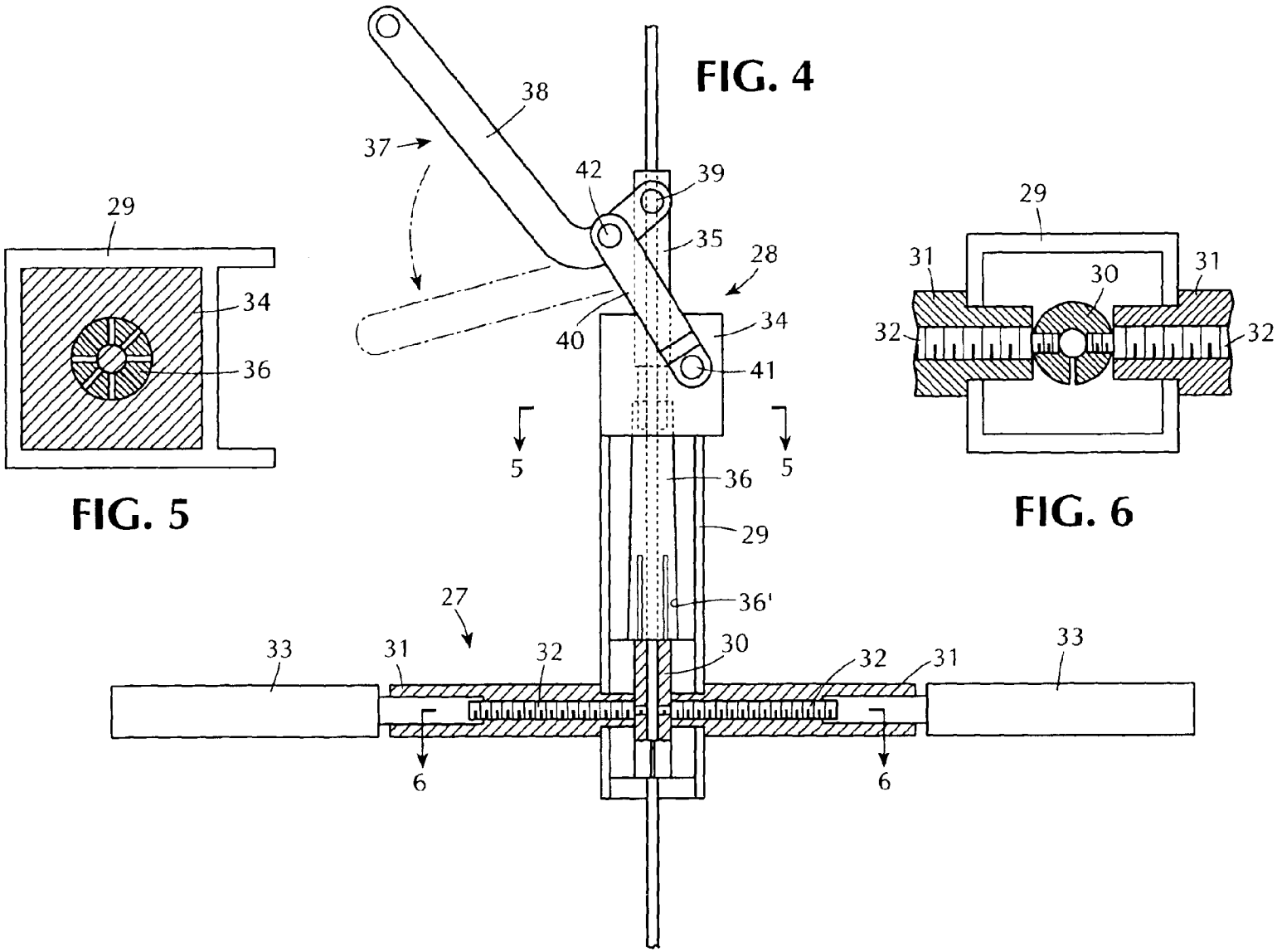
FIG. 4 illustrates a partial cross-sectional view of a regulating brake and emergency brake employed with the escape device of FIGS. 1 to 3.
FIG. 5 illustrates a cross-sectional view taken on line 5—5 of FIG. 4.
FIG. 6 illustrates a view taken on line 6—6 of FIG. 4.

Referring to FIG. 4, the speed regulating brake 27 and emergency brake 28 are formed as a unit for mounting on the top of the guide 18 via common tubular housing 29. (see FIG. 2).

The speed regulating brake 27 includes a vertically disposed split sleeve 30 for slidably receiving the cable means 12, a pair of internally threaded bars 31 which extend horizontally from opposite sides of the sleeve 30 and a pair of threaded screws 32. As indicated, each bar 31 has a reduced section to pass into the housing 29 and each screw 32 is threaded into a bar 31 as well as into the sleeve 30. In this respect, the screws 32 have opposite hand threads. Alternatively, each screw 32 may have a smooth stem which fits into the sleeve 30.

In addition, the speed regulating brake 27 includes a pair of handles 33, each of which is rotatably mounted in a bar 31 and secured to a screw 32 whereby rotation of the handle 33 causes the screw 32 to turn thereby cause the slit sleeve 28 to selectively open or close on the cable means 12. For example, rotating the handle 33 to move the attached screw 31 towards the split sleeve 30 causes the sleeve 30 to close on the cable means 12. Rotation of the handle 33 in opposite direction pulls the split sleeve 30 apart to be released from the cable means 12 (FIG. 6).

The emergency brake 28 has a mounting block 34 which is fixed to the housing 29 at an upper end, a vertically disposed tube 35 which is slidably mounted in the top of the block 34 to project upwardly and a conically shaped sleeve 36 which is secured to a threaded stem on the tube 35. This sleeve 36 has a slotted lower end which is slidably disposed within a tapered bore 36' in the block 34 and receives the cable means 12 concentrically therein. A toggle mechanism 37 is mounted on and secured to the projecting tube 35 for selectively pulling the tube 35 from the block 34 in order to move the slotted lower end of the sleeve 36 further into the block 34 to circumferentially engage the cable means 12.

As illustrated, the toggle mechanism 37 includes a first lever 38 which is pivotally connected to the tube 35 via a pin 39 for manual pivoting between a release position, as shown in solid line, and a locking position as shown in dotted line. In addition, the toggle mechanism 37 includes a second lever 40 which is pivotally connected to and between the block 34, via a pin 41, and the first lever 38 via a pin 42. When the first lever 38 is in the released position, the conically shaped sleeve 36 is disposed at a lowermost point relative to the mounting block 34. When the lever 38 is pivoted into the locking position, the tube 35 rises up from the mounting block 34 to pull the sleeve 36 into the mounting block 34 so that the slotted end compressed about the cable means 12 (FIG. 5).

Figure 9:
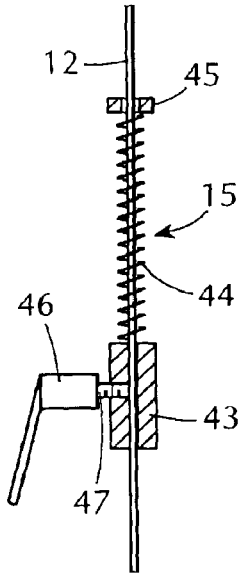
FIG. 9 illustrates a cross-sectional view of a shock absorber employed with the escape device.
Figure 10:
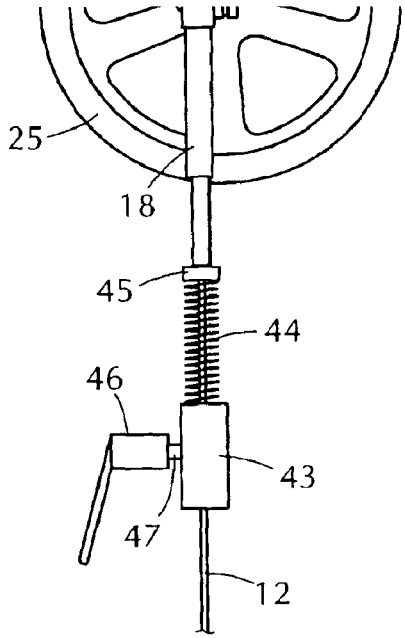
FIG. 10 illustrates a view of the escape device impacting on the shock absorber of FIG. 9.

Referring to FIG. 9, the shock absorber 15 includes a mounting block 43 which is slidably mounted on the cable means 12, a resilient member 44, such as a spring, disposed concentrically of the cable means 12 and seated on the block 43 and a washer 45 mounted on the resilient member 44 for impacting of the guide 18 thereon as indicated FIG. 10. The shock absorber 15 also includes an adjustable means 46 which is mounted on the block 43 for selectively securing the block 43 to the cable means 12. As illustrated, the adjusting means 46 include a threaded screw 47 which is threaded into the mounting block 43 to abut the cable means 12. In addition, a handle 45 is secured to the screw 47 to permit manual rotation of the screw 47 to selectively release and secure the block 43 along the cable means 12.

In order to use the escape device 10, a building 11 would be provided with one or more anchor means 14, located outside the building and above selected windows 48 of the building (FIG. 1). The escape device 10 would be stored in a suitable position within the building 11. Thus, should there be a smoke or fire conditions within the building 11 which requires an escape through an open window, the occupant of the building would first obtain the escape device and then, after opening a window, attach the hook 13 on the cable means 12 to the anchor means 14 (see FIG. 8). In this respect, the eyelet 17 of the anchor means 14 should be large enough to allow more than one cable means 12 to be attached. Alternately, a pair of anchor means may be installed outside the window to allow more than one person to escape.

After attaching the cable means 12 to the anchor means 14, the seat 19 is positioned to receive the occupant 21. In this respect, the seat 19 may be disposed immediately outside the window with the respective brakes 27, 28 engaged to lock the guide 18 to the cable means 12. The user may then step out of the window to be seated onto the seat 19, for example, in the position as shown in FIG. 2.

After being seated and fastening the belt 22, the occupant 20 would release the emergency brake 28 by lifting the lever 38 upwardly into the solid line position shown in FIG. 4. Next, the speed regulating brake 27 would be slowly actuated to release the split sleeve 30 from engagement with the cable 12. At this time, the escape device 10 would begin to slide downwardly along the cable means 12. During descent, the occupant 21 may regulate the rate of descent by rotating one or both of the handles 33 of the speed regulating brake 27. In the event that the speed becomes excessive, the occupant 21 would activate the emergency brake 28 by pulling down on the lever 38.

As the escape device 10 approaches ground level, the guide 18 will impact against the washer 45 of the shock absorber 15 as indicated in FIG. 10. At this time, the occupant may reach down to rotate the handle 48 in order to permit further descent on the cable means 12 to ground level. The occupant 21 would then step out of the escape device 10.

Figure 14:
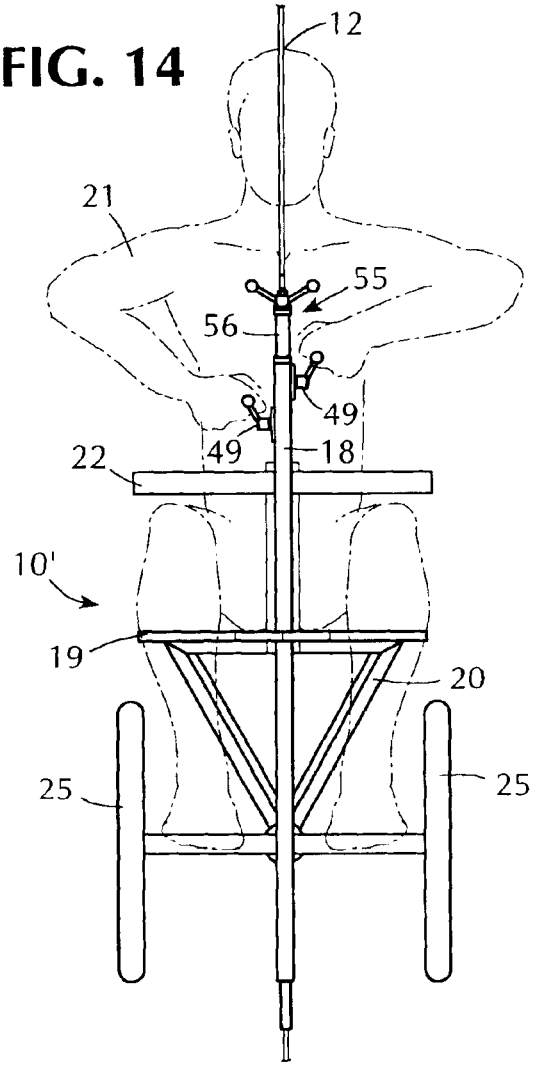
FIG. 14 illustrates a front view of a modified escape device employing a modified speed regulating brake and modified emergency brake in accordance with the invention.

Referring to FIG. 14, wherein like reference characters indicate like parts as above, the escape device 10' may be provided with a different brake arrangement. As shown, the escape device 10 has a pair of speed regulating brakes 49 disposed on opposite sides of the guide 18. Each of these brakes 49 is of the power screw type which allows a mechanical advantage of the occupant 21 applying the brake 49 as well as rapid or "hands on" control. The power screw technique has the advantage of allowing the occupant 21 to make a drag adjustment during descent.

Figure 15:
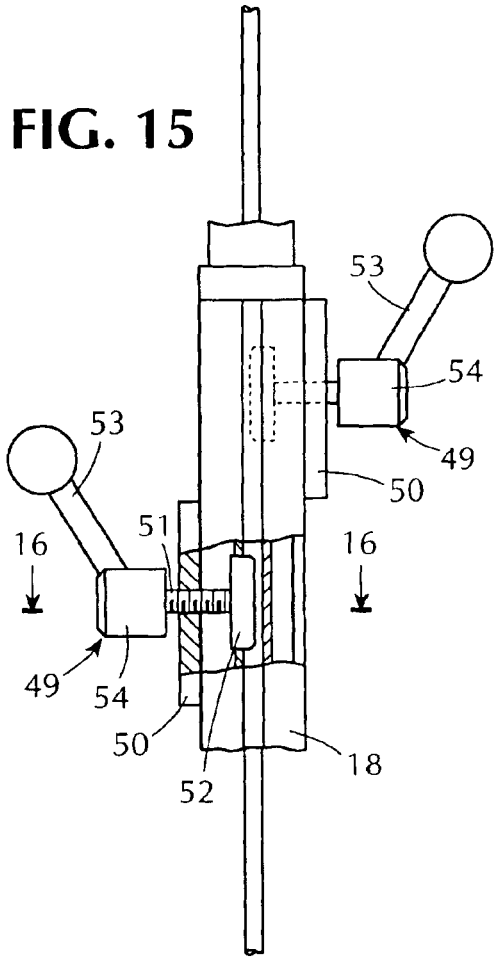
FIG. 15 illustrates a part cross-sectional view of a speed regulating brake constructed in accordance with the invention.
Figure 16:
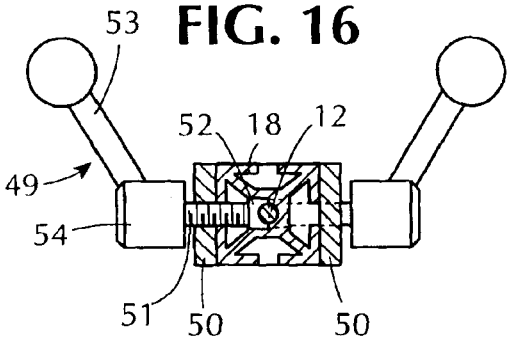
FIG. 16 illustrates a view taken on line 16—16 of FIG. 15.

Referring to FIGS. 15 and 16, each speed regulating brake 49 includes a mounting plate 50 which is secured to the guide 18, a threaded screw 51 which is threadably mounted in the plate 50, a brake shoe 52 which is mounted on the end of the screw 51 within the guide 18 for engaging the cable means 12 passing through the guide 18 and a manually grippable lever 53 secured to the screw 51 for rotating the screw 51 in the mounting plate 50 in order to move the brake shoe 52 into engagement with the cable means 12. As shown, the lever 53 has a hub 54 which receives the screw 51 in fixed relation.

The mounting plate 50 may be secured to the guide 18 by bolts so as to be retained in a fixed position.

The brake shoe 52 is received in a recess of the guide 18 so as to be held in a fixed position as indicated in FIGS. 15 and 16. Further, the brake shoe is provided with a semi-circular recess for receiving the cable means therein as indicated in FIG. 16.

In addition, as shown in FIG. 14, the escape device 10' is provided with a different emergency brake 55 located above the speed regulating brakes 49.

Figure 17:
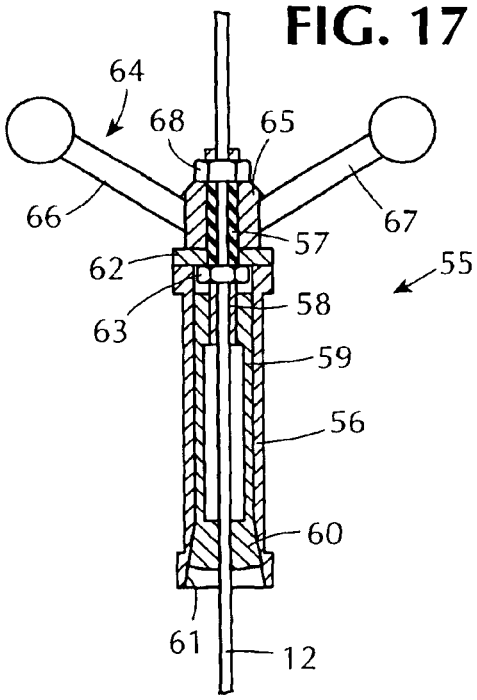
FIG. 17 illustrates a part cross-sectional view of the emergency brake of FIG. 14.

Referring to FIG. 17, the emergency brake 55 includes a housing 56 which is secured to the top of the guide 18 (see FIG. 14). In addition, the emergency brake 55 has a hollow stem 57 disposed coaxially of the housing 56. This stem 57 has a reduced threaded portion 58 within the housing 56 onto which a split sleeve 59 is threadably mounted within the housing 56. The split sleeve 59 has a conically shaped lower end 60 which is disposed in mating relation with a conically shaped internal surface 61 of the housing 56.

As shown in FIG. 17, the hollow stem 57 passes through a plate 62 which is secured, as by bolts (not shown) to the upper end of the housing 56. In addition, a nut 63 is threaded onto the threaded stem 58 to abut the underside of the plate 62.

A lever assembly 64 is secured to the hollow stem 57 for rotating the stem 57 in order to pull the lower end of the split sleeve 59 into the housing 56 in order to engage the cable means 12. As illustrated, the lever system 64 includes a hub 65 which is disposed about the hollow stem 57 and which is fixed thereto in any suitable manner.

In addition, the lever assembly 64 includes a pair of levers 66, 67 which project from the hub 65 to permit manual rotation of the hub 65 and, thus, the hollow stem 57. A nut 68 is threaded onto a projecting reduced threaded portion 69 of the hollow stem 57 to secure the hollow stem 57 and hub 65 in place on the plate 62.

Rotation of the lever assembly 64 causes rotation of the hollow stem 57 and thus the threaded stem 58. This, in turn, causes the split sleeve 59 to move upwardly or downwardly depending upon the direction of rotation of the threaded stem 58. In this respect, a key (not shown) is provided between the split sleeve 59 and the housing 56 to prevent relative rotation therebetween.

The emergency brakes used with the embodiments of FIGS. 1 to 10 or 14 to 17 are to be set for the heaviest occupant. This results in a sudden stop when activated.

Figure 11:
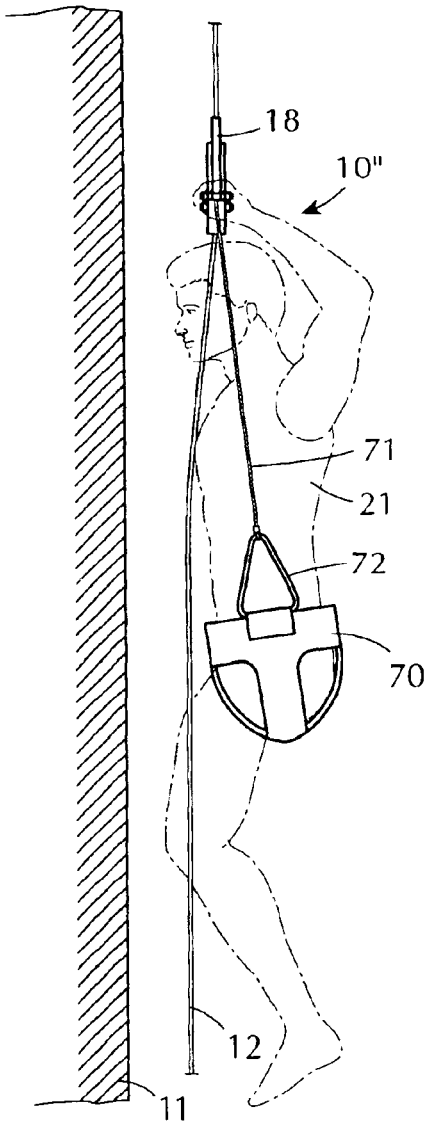
FIG. 11 illustrates a second embodiment of an escape device in which a sling is used.
Figure 12:
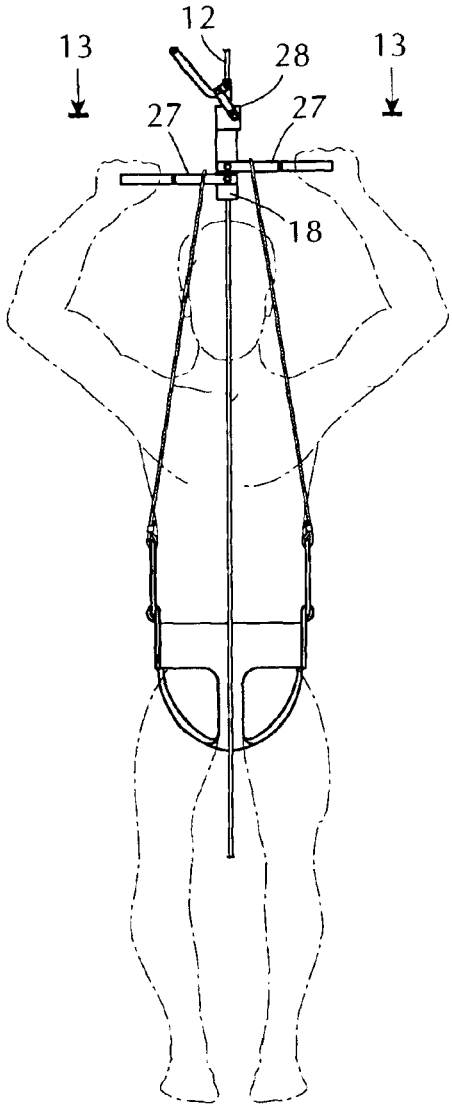
FIG. 12 illustrates a front view of the escape device of FIG. 11.

Referring to FIGS. 11 and 12, wherein like reference characters indicate like parts as above, the escape device 10" is further modified for a more agile user. In this embodiment, the escape device 10" has a sling 70 suspended from the guide 18 for receiving an individual. As illustrated, the sling 70 includes a seat made of fabric material for receiving an occupant 21 in a seated manner and a pair of cables 71 which are attached to opposite sides of the sling 70 via metal triangular pieces 72. The upper end of each cable 71 is secured to a horizontal bars 31 of the speed regulating brakes 27. In this embodiment, the escape device 10" employs a guide 18 of relatively short length, for example, of from 12 to 15 inches.

As above, the escape device 10" may have a pair of speed regulating brakes 27 and an emergency brake 28 corresponding to the embodiment shown in FIG. 4.

Figure 13:
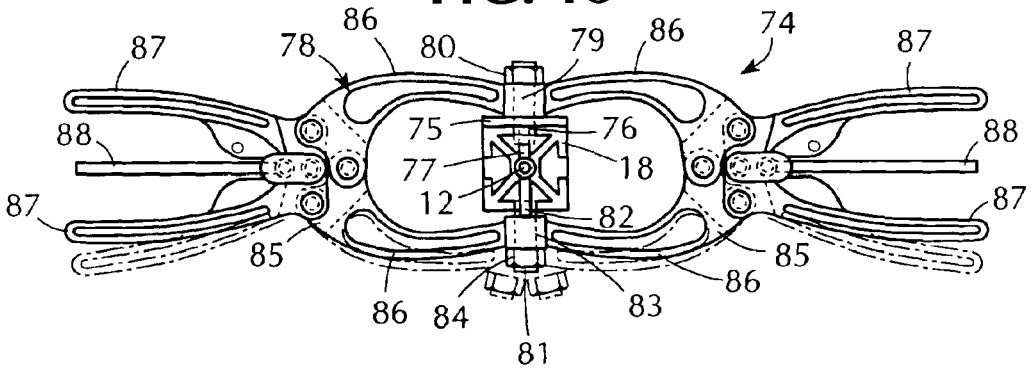
FIG. 13 illustrates a top view taken on line 13—13 of FIG. 12 of a speed regulating brake constructed in accordance with the invention.

Alternatively, referring to FIG. 13, a vise-like speed regulating brake 74 may be employed. As illustrated, the brake 74 has a mounting plate 75 secured to the guide 18, for example, by bolts. A threaded screw 76 passes in threaded relation through the plate 75 and into the guide 18. The screw 76 has a reduced stem 77 which engages against the cable means 12 passing through the guide.

A vise-like unit 78 having a hub 79 is mounted over the threaded screw 76 and secured in place by a nut 80 which is threaded onto the screw 76 in abutment against the hub 79.

A threaded screw 81 is disposed opposite the screw 76 but has a smooth reduced portion 82 which passes into the guide 18 to engage in a brake shoe which abuts against the cable means 12 as shown in FIG. 15. A second hub 83 of the vise-like unit 78 is slidably mounted on the reduced stem 82 for movement therealong. In addition, a nut 84 is threaded onto the screw 81 to act as a stop for the hub 83. As illustrated in FIG. 13, when the vise-like unit 78 is in the solid line position, the hub 83 is spaced from the guide 18 and thus the smooth stem 82 is removed from engagement with the cable means 12. This is the release position of the vise-like brake 74.

The brake 74 also has a pair of plier-like units 85 which are of identical construction and are independent of each other to be separately operated. Each unit 85 has a pair of pivotally mounted jaws 86 which are integrally connected to the respective hubs 79, 83. These jaws 86 are articulated to arms 87 via a toggle arrangement. The articulation is such that when the arms 87 move from the solid line position to the dotted line position, the corresponding jaw 86 move from the solid line position to the dotted line position. At the same time the toggle arrangement serves to lock the jaws 86 in position.

When the arms 87 and jaws 86 are in the closed solid line position, the reduced portions 77, 82 of the screws 76, 81 are in locking engagement with the cable means 12. The arms 87 and corresponding jaws 86 are moved to the dotted line position, the reduced stem 82 is moved away from the cable means 12.

Each plier-like unit 85 also has a lever 88 that breaks the toggle lock in known manner.

The embodiment of FIGS. 11 and 12 may also have a shock absorber mounted on the cable means 12, for example, as shown in FIG. 1.

While three different types of speed regulating brakes have been described above, any one of the speed regulating brakes may be used with the various embodiments described above. Likewise, while two types of emergency brakes have been described above, any one of the emergency brakes may be used with any embodiment of the escape device.

The escape device illustrated in FIGS. 1 to 7 may be used to transport more than one individual. For example, one adult and a child seated on the lap of the adult may be transported. The seat belt allows the two persons to be seated and secured in place.

The escape device may also be constructed with a double seat in order to transport two individuals simultaneously. For example, two seats 19 may be secured to the guide device 18 in a symmetrical manner with separate truss-like frames 23 securing each seat 19 to the vertical guide 18. Either occupant may then manipulate the brakes. This construction would be particularly suitable where one of the occupants is not conscious or is otherwise unable to manipulate the brakes.

When the escape device is constructed as a double seat arrangement, the two seats may be arranged on an axis perpendicular to the axle of the wheels 26 in cases where the seats would be within the plane of the wheels 26. For larger versions, the double seat arrangement would have the seats disposed on an axis parallel to the axle of the wheels 26 to allow the seats to project beyond the plane of the wheels 26. In this instance, the risk of the occupants scrapping against the wall of the building would be minimized.

The cable means 12 is sized and made of suitable materials to carry the weight of the escape device including the cable means and the occupant or occupants. For example, a steel wire of 0.188 inch diameter would be suitable to carry a load of 300 pounds. Larger cable means may be used for carrying larger loads, e.g. a cable means having a ¼ inch diameter may carry a load of from 300 to 500 pounds. The cable means may also be marked at intervals of ten feet to indicate length of cable and to allow the setting of stops according to the floor that the potential user is occupying.

Figure 19:
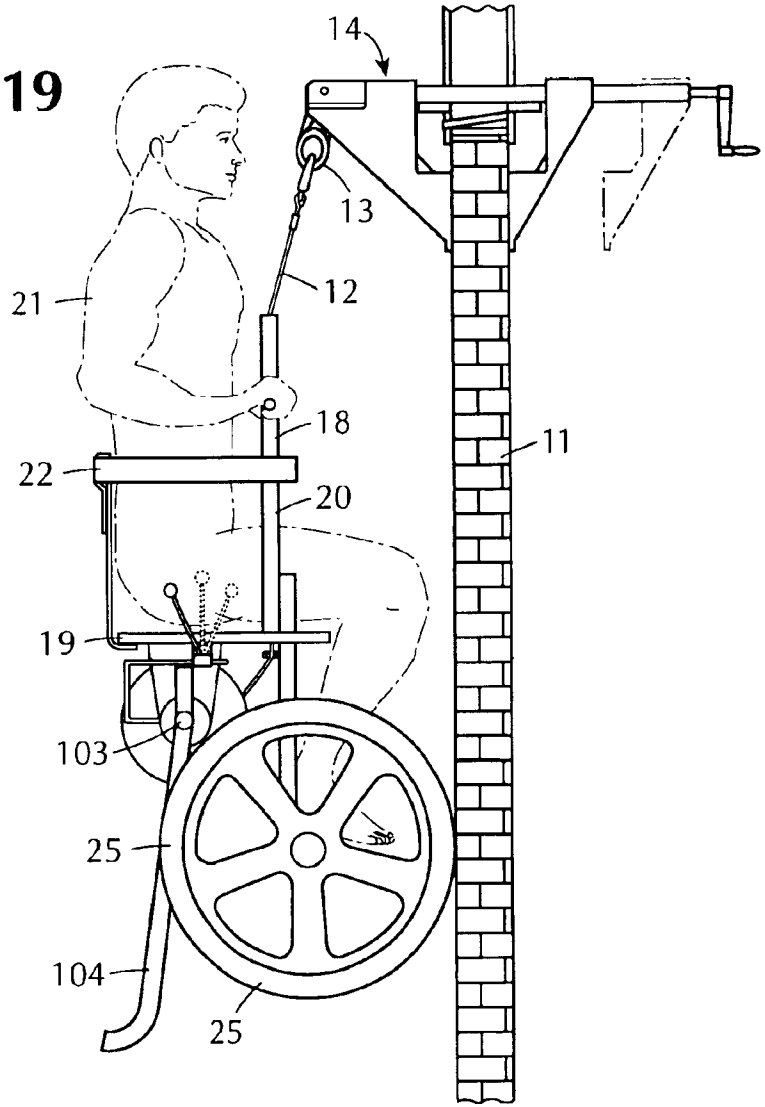
FIG. 19 illustrates a side view of the escape device of FIG. 18.
Figure 18:
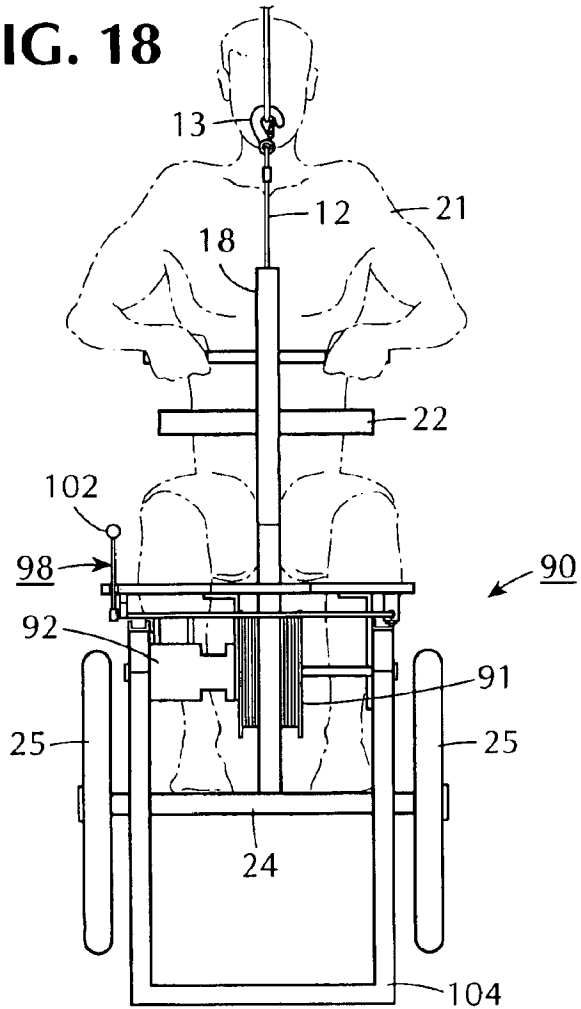
FIG. 18 illustrates a front view of a further modified escape device in accordance with the invention.

Referring to FIGS. 18 and 19, wherein like reference characters indicate like parts as above, the escape device 90 has a frame 20 with a seat 19 mounted thereon as above. In addition, a pair of rotatable wheels 25 are mounted on the frame 20 below the seat 19 for spacing the seat 19 from a building 11.

A guide 18 is vertically disposed on the frame at a forward position of the seat for guiding a cable means 12 therethrough.

Figure 21:
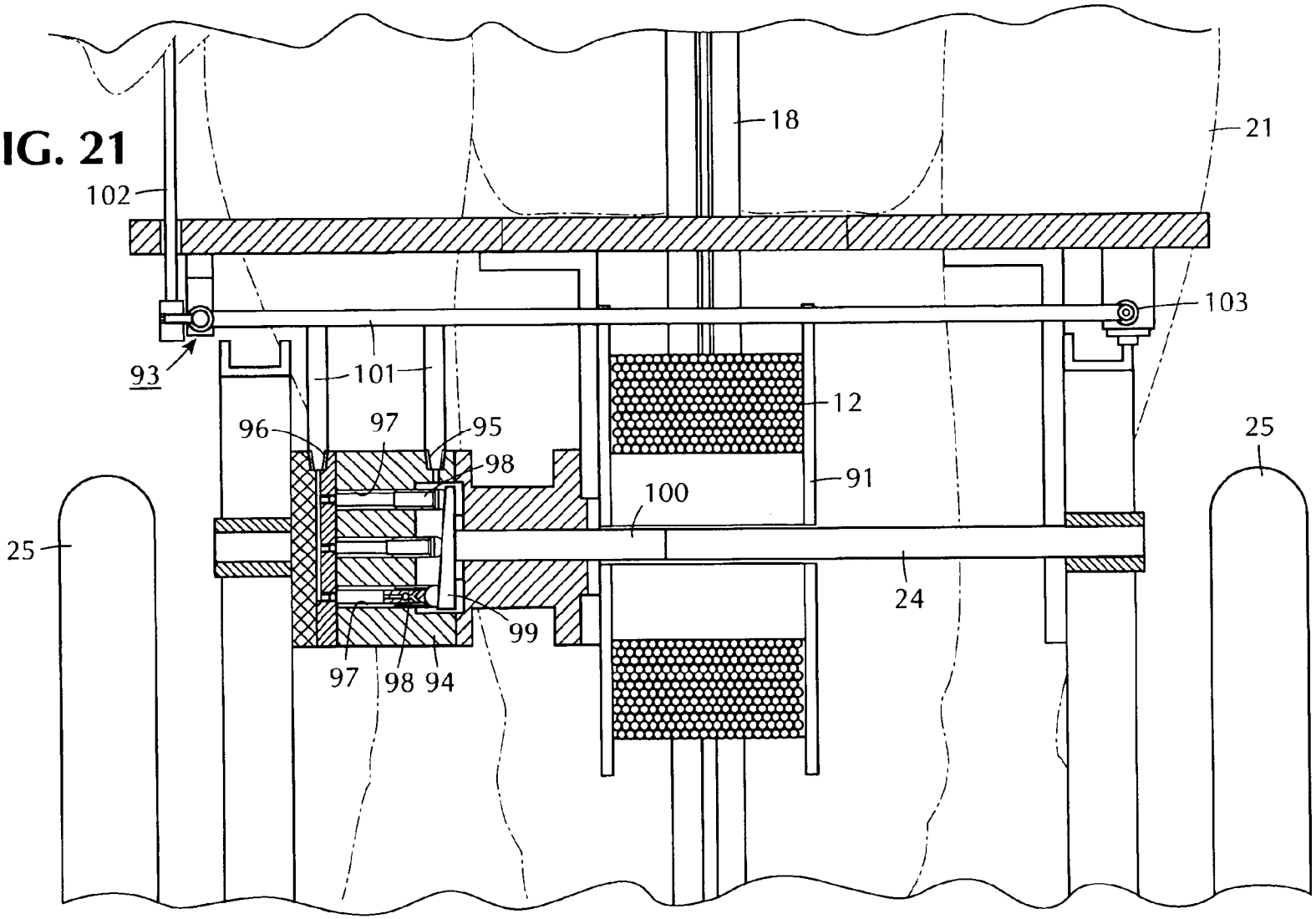
FIG. 21 illustrates a further enlarged front view of a portion of the escape device of FIG. 18.

In this embodiment, a reel 91 is mounted on the shaft 24 to rotate with the wheels 25 and receives the cable means 12 in a wound condition. As indicated in FIG. 21, a substantial length of cable means 12 may be wound on the reel 91. For example, a length of 100 feet or more may be wound onto a suitably sized reel 91.

As also shown in FIG. 21, an energy absorber 92 is mounted on the frame 20 below the seat 19, and is operatively connected to the reel 91 to regulate rotation of the reel 91.

As illustrated in FIGS. 18 and 19, a manually operable speed-regulating valve 93 is mounted on the frame 20 for adjusting the energy absorber 92 to control the speed of rotation of the reel 91 and, thus, control the rate of descent of the frame 20 along the cable means 12.

Referring to FIG. 21, the energy absorber 92 preferably includes a housing 94 of block-like construction having an inlet 95 for an inflow of hydraulic fluid, an outlet 96 on an opposite side for an outflow of hydraulic fluid and a plurality of circumferentially disposed passages 97 to conduct a flow of hydraulic fluid from the inlet 95 to the outlet 96. Other rotary energy absorbers, such as, brake discs, could be employed to control descent.

Further, a plurality of piston check-valves 98 are slidably mounted in the respective passages 97 in order to move between a retracted position to allow hydraulic fluid to flow from the inlet 95 into a respective passage 97 and an extended position to discharge hydraulic fluid from the passage 97 towards the outlet 96.

In the position illustrated in FIG. 21, the upper-most check-valve 98 is in a retracted position that allows fluid to pass from the inlet 95 to the outlet 96. The lower-most check-valve 98 is in the fully extended position that blocks flow from the inlet 95 to the outlet 96.

A wobble plate 99 is secured by a stem shaft 100 to the reel 91 in order to rotate with the reel 91. As illustrated, the wobble plate 99 has an inclined face directed toward the check-valves 98 and is connected to each check-valve 98 to reciprocate the respective valves 98 in the passages 97.

A hydraulic line 101 is connected to and between the inlet 95 and outlet 96 to form a closed loop for the hydraulic fluid.

The regulating valve 93 is disposed in the hydraulic line 101 to selectively open and close the hydraulic line 101 to a flow of hydraulic fluid. As illustrated in FIG. 21, the valve 93 has an upstanding lever 102 which can be manually grasped by the occupant 21 in order to move the valve 93 from a fully-closed position to a fully-open position. When the valve 93 is in the fully-closed position, fluid may not flow through the hydraulic line 101. As a result, the wobble plate 99 is held against rotation and, thus, the reel 91 is locked against rotation. As the valve 93 is opened, fluid flow is allowed to pass through the valve 93 to flow from the outlet 96 back to the inlet 95. The valve 93 thus serves as a throttle means to throttle the flow of hydraulic fluid in the line 101. This, in turn, controls the speed of rotation of the reel 91 and, thus, the unwinding of the cable means 12.

A second valve 103 is also disposed in the hydraulic line 101 for selectively opening and closing the hydraulic line 101 to a flow of hydraulic fluid therethrough. This valve 103 may be in the form of a plunger valve and is connected to a tail skid 104 (see FIG. 19) that is pivotally mounted on the frame 20 in a depending fashion. In this respect, the valve 103 is located on the pivot axis of the tail skid 104. Hence, as the tail skid 104 rotates, or pivots, the valve 103 moves from a fully open position corresponding to the position of the tail skid 104, as illustrated in FIG. 19, to a fully closed position when the tail skid 104 abuts a ground surface and is moved outwardly from the wheels 25 of the escape device 90. As illustrated in FIG. 19, the lower end of the skid 104 is curved away from the wheels 25 in order to move in a direction away from the wheels 25 when contacting a ground surface.

In operation, when the tail skid 104 contacts a ground surface and is pivoted outwardly, the plunger valve 103 is rotated in order to close the hydraulic line 101 to thereby brake the reel 91 and, thus, stop continued descent of the escape device.

The escape device 90 may be modified in a manner as described above to accommodate two persons in seated positions.

Figure 20:
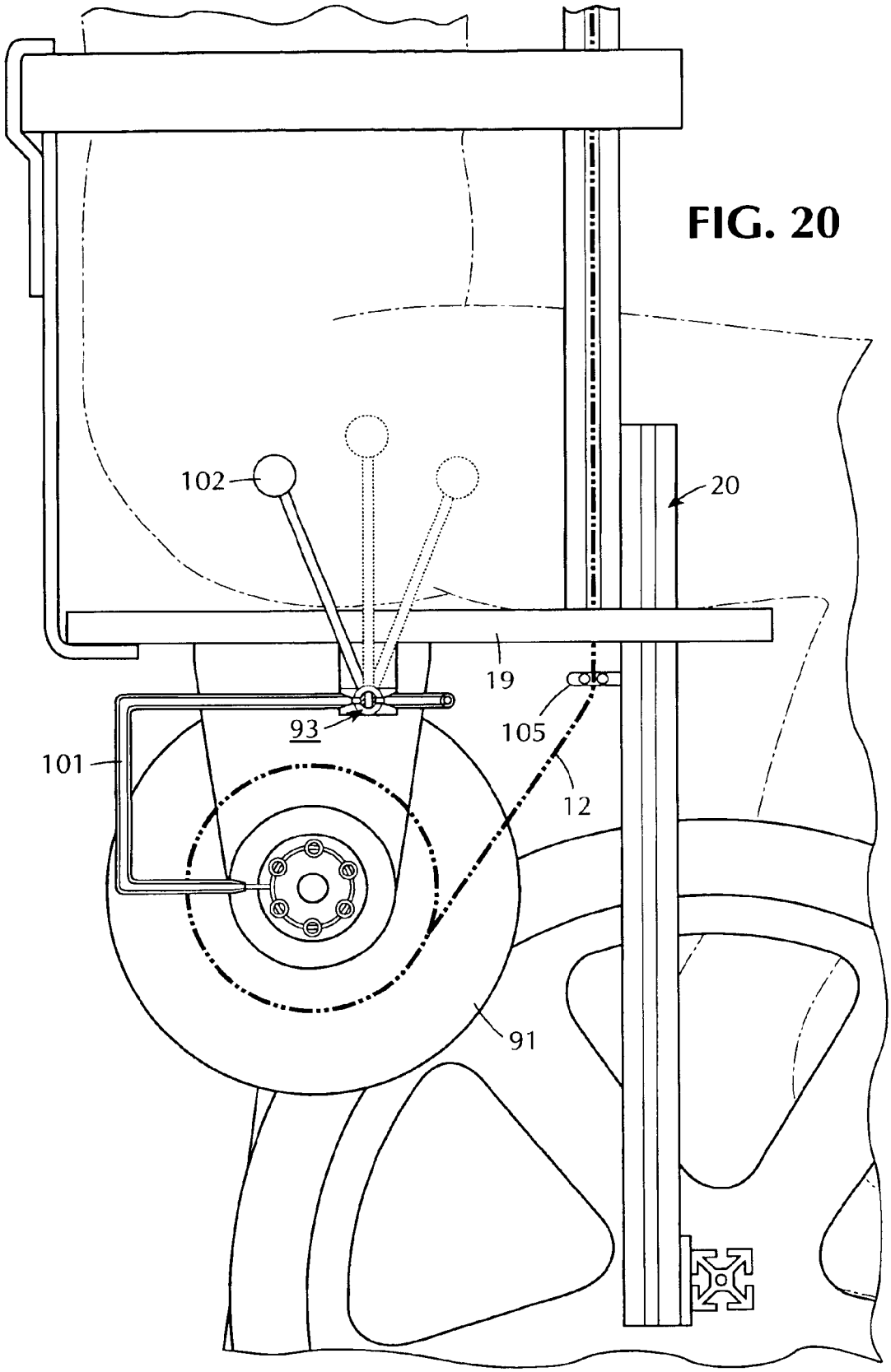
FIG. 20 illustrates an enlarged view of the escape device of FIG. 19.

Referring to FIG. 20, the guide 18 terminates at the seat 19 so that the cable means 12 may be passed through a guide 105, such as an eyelet, secured to the frame 20 for guidance to the reel 91.

In this embodiment, the hydraulic energy absorber controls the rate of descent to one which is much less than one produced by free-fall acceleration. The hydraulic absorber may be construed to allow a maximum speed approximately equivalent to a free-fall impact experienced by jumping from about a four-foot-high platform above ground. This velocity, about 16 feet per second, would be the maximum impact velocity without braking.

Automatic braking is provided by the tail skid 104 prior to the point of the wheel impact. The tail skid 104 is in the form of a U-shaped bar that is pivotally mounted on the frame 20 (see FIG. 18). In addition, the lower end of the tail skid 104 is bent outwardly, as indicated in FIG. 19, in a rearward direction away from the wheels 25 to facillitate pivoting of the skid in a direction away from the wheels 25 when coming into contact with a ground surface.

In operation, a user would secure the hook 13 of the cable means to the anchor means 14. Thereafter, the escape device would be placed outside the wall 11 of the building so that the user may then occupy the seat 19 of the device 90. Once buckled in place, the occupant 21 is ready to proceed downward. The occupant 21 then moves the lever 102 to a release position to allow the reel 91 to begin unwinding. By controlling the lever 102, the amount of hydraulic fluid pass through the hydraulic line 101 and the amount of braking is controlled. As the escape device nears a ground surface, the control lever 102 may be returned to the closed position to slow the descent of the escape device 90. Also, the tail skid 104 functions to further brake the descent of the escape device 90 upon contacting the ground surface.

The escape device 90 is constructed to be completely self-contained. However, a gasoline engine and two clutches can be added to the shaft of the energy absorber 92 in order to allow the escape device 90 to return to a floor of the building or to pick up occupants at a lower floor, if time permits. In this fashion, the motor is used to rewind the cable means on the reel 91.

While the escape device has been described principally for use in escaping from a burning building, the escape device may find use in other embodiments. For example, the escape device may be employed for lowering an injured person from a ledge of a mountain, ski slope or the like. Where the injured person is not able to manipulate the brakes, the double seat arrangement of the escape device could be employed. In this case, an uninjured user would manipulate the brakes while the injured person remains seated in the opposite seat. One advantage of the escape device in such uses is that the wheels may act as bumpers and guides.

The escape device may also be constructed to fold into a more compact space for purposes of shipping or storage. In addition, the escape device may also function as a luggage carrier, for example, for transporting luggage in an airport. In this way, an individual having a fear of fire may transport his/her own escape device to a hotel or motel, for example when taking a trip.

The invention thus provides an escape device which is individually operated.

The invention further provides an escape device which can be easily stored and put into use when the need arises.

The invention further provides an escape device which simulates the sliding of a fireman down a firehouse pole. Further, placement of the speed regulating brake on the guide device at a convenient location provides ready access for the user during descent. Likewise, placement of the emergency brake on the guide device is also convenient to the user.

The invention further provides a seat-type escape device which provides stability and a sense of safety to an occupant while descending from and along a burning building.

Further, the invention provides a sling-type escape device which can be folded into a relatively small compact space when not in use.

What is claimed is:

1. An individually operated escape device for escaping from a burning building, said device comprising a frame having a seat for receiving at least one individual thereon;

at least one rotatable wheel mounted on said frame below said seat for spacing said seat from a building;

a vertically disposed guide mounted on said frame at a forward position of said seat for guiding a cable means therein;

a reel rotatably mounted on said frame below said guide for unwinding of the cable means therefrom;

a hydraulic energy absorber mounted on said frame and operatively connected to said reel to regulate rotation of said reel; and a manually operable speed regulating valve mounted on said frame for adjusting said hydraulic energy absorber to control the speed of rotation of said reel to control a rate of descent of said frame along the cable means, wherein said energy absorber includes a housing having an inlet for an inflow of hydraulic fluid, an outlet for an outflow of hydraulic fluid and a plurality of circumferentially disposed passages for a flow of hydraulic fluid form said inlet to said outlet; a plurality of piston check valves, each said check valve being slidably mounted in a respective passage to move between a retracted position to allow hydraulic fluid to flow from said inlet into said respective passage and an extended position to block flow of hydraulic fluid from said inlet into said respective passage while discharging hydraulic fluid from said respective passage through said outlet; and a wobble plate connected to said reel to rotate therewith and connected to each said piston check valve to reciprocate each said piston check valve in a respect passage between said positions thereof, and a hydraulic line connected to and between said inlet and said outlet to define a closed loop, and comprising another valve in said hydraulic line for selectively opening and closing said line to a flow of hydraulic fluid therethrough and a tail skid pivotally mounted on said frame in depending relation, said tail skid being connected to said another valve to actuate said another valve to close said hydraulic line in response to said skid contacting a ground surface and pivoting relative to said frame.

2. An escape device as set forth in claim 1 wherein said regulating valve is disposed in said hydraulic line to selectively open and close said line to a flow of hydraulic fluid therethrough.

3. A device as set forth in claim 1 which further comprises an adjustable belt mounted on said guide above said seat for enveloping an individual seated on said seat.

4. A device as set forth in claim 3 which further comprises at least one flexible strap secured to and between said belt strap and said seat to contain an individual on said seat.

5. A device as set forth in claim 1 wherein said guide has a skeletal cross-section of rectangular shape.

6. A device as set forth in claim 5 which further comprise a cable means passing through said guide.

7. A device as set forth in claim 6 wherein said cable means is one of a wire and a braided cable.

* * * * *